United States Patent [19]

Berggren

[11] 4,079,215

[45] Mar. 14, 1978

[54] SWITCHING DEVICE WITH PRESSURE ACTUATION OF PLURAL SWITCHES

[75] Inventor: Karl-Erik Berggren, Farsta, Sweden

[73] Assignee: A-Kyl i Farsta AB, Farsta, Sweden

[21] Appl. No.: 693,955

[22] Filed: Jun. 8, 1976

Related U.S. Application Data

[62] Division of Ser. No. 542,401, Jan. 20, 1975, Pat. No. 3,977,650.

[30] Foreign Application Priority Data

Jan. 18, 1974 Sweden ..... 7400672
Sep. 27, 1974 Sweden ..... 7412197

[51] Int. Cl.[2] ..... H01H 35/24
[52] U.S. Cl. ..... 200/81.4; 200/83 D; 200/83 R
[58] Field of Search ..... 200/83 R, 83 D, 81.4, 200/81.5; 92/35; 62/209, 196; 251/129

[56] References Cited

U.S. PATENT DOCUMENTS

| | | | |
|---|---|---|---|
| 2,226,297 | 12/1940 | Spangenberg | 200/81.4 |
| 2,930,866 | 3/1960 | Peterson | 200/81.4 |
| 3,182,149 | 5/1965 | Noakes | 200/81.4 |
| 3,183,322 | 5/1965 | Singer | 200/81.4 |
| 3,946,174 | 3/1976 | Herbst | 200/81.4 |

*Primary Examiner*—Gerald P. Tolin
*Attorney, Agent, or Firm*—Cushman, Darby & Cushman

[57] ABSTRACT

A switching device responsive to pressure at one or two inputs with pressure responsive members each of which moves an actuating member in response to pressure variations. First and second electrical switches are positioned to be operated by the respective actuating members and a third switch is mounted for movement with one of the members and actuated by the other member. In one embodiment, a first compression spring acts between a housing and an actuating member which is moved in response to pressure variations. A second spring extends in parallel with the first spring and acts between the housing and a pivotably mounted lever which is lifted by the first actuating member above a desired pressure level.

1 Claim, 8 Drawing Figures

SWITCHING DEVICE WITH PRESSURE ACTUATION OF PLURAL SWITCHES

This is a division, of application Ser. No. 542,401 filed Jan. 20, 1975 now U.S. Pat. No. 3,977,650.

The present invention relates to a switching device with at least one force or pressure input, at which a force or pressure responsive means is adapted to actuate a movable contact of an electric switch by means of an actuating means upon the occurrance of a force of a predetermined magnitude or a predetermined pressure at the respective pressure input.

One object of the invention is to provide a force or pressure responsive switching device, which in a versatile way can perform electric switching operations under the influence of variations of forces or pressures acting on the switch device. Another object is to provide a switching device for use in freezer refrigerator machines, which is actuated by the pressures at the high pressure and low pressure sides of the refrigerator machine and can provide a start impulse, when the starting torque is at a minimum at start relief, and can also operate as a pressure control for the high and low pressures.

According to one aspect a pressure or force responsive switching device with at least one pressure or force input, wherein a force or pressure responsive member is adapted in a first position to actuate a movable contact element of an electric switch by means of an actuating member upon the occurrance of a predetermined force or a predetermined pressure at the pressure input, is characterized in that the actuating member is adapted in a second position to actuate a movable contact element of an additional electric switch upon the occurrance of a force or a pressure at the pressure input, which is different from the first-mentioned pressure.

According to a further aspect a pressure or force responsive switching device comprising two force or pressure inputs, wherein one force or pressure responsive member each is provided for actuating a movable contact element of one electric switch each by means of an actuating member upon the occurrance of a predetermined pressure at the respective pressure input, is characterized in that a third electric switch with a movable contact element is provided for movement with one of the actuating members and that the second actuating member when moved away from the corresponding contact element actuating position thereof is adapted to meet the third switch for actuating the movable contact element thereof upon movement of the third switch caused by the movement of said one actuating member from the contact element actuating position thereof.

Figure 1:
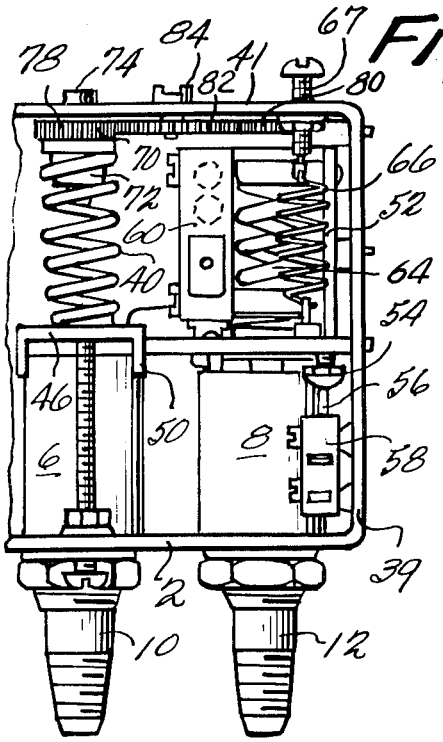
Figure 2:
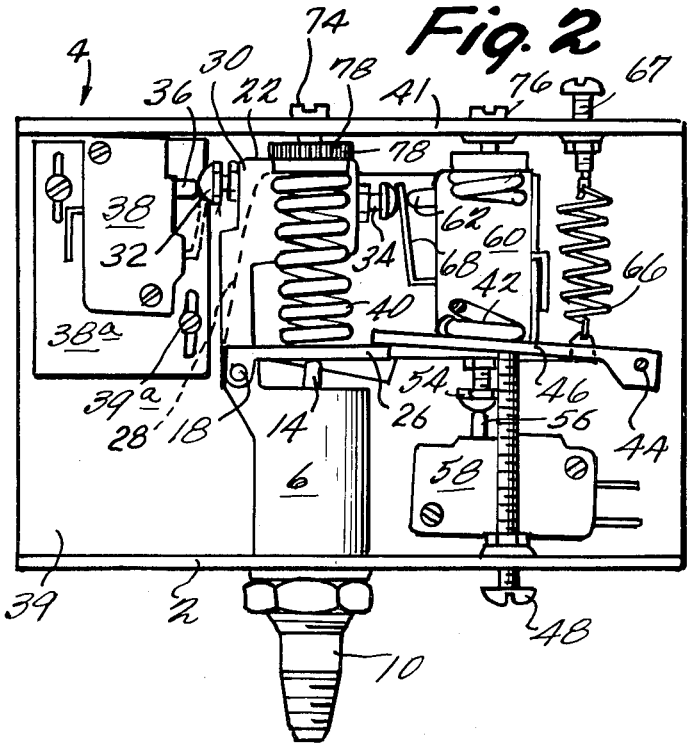
Figure 3:
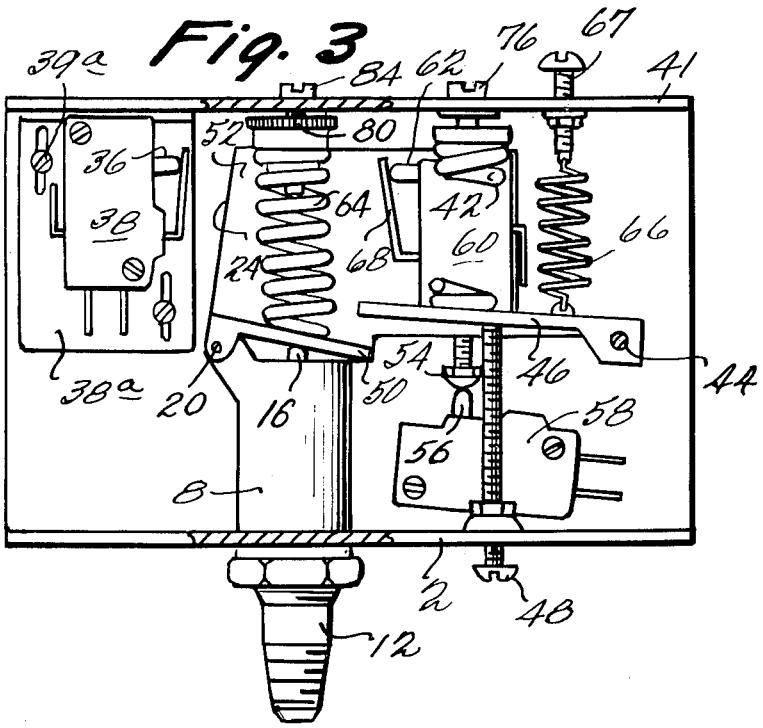
Figure 4:
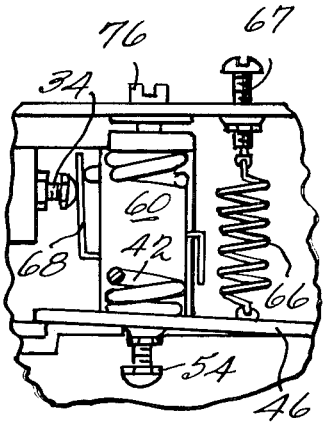
Figure 6:
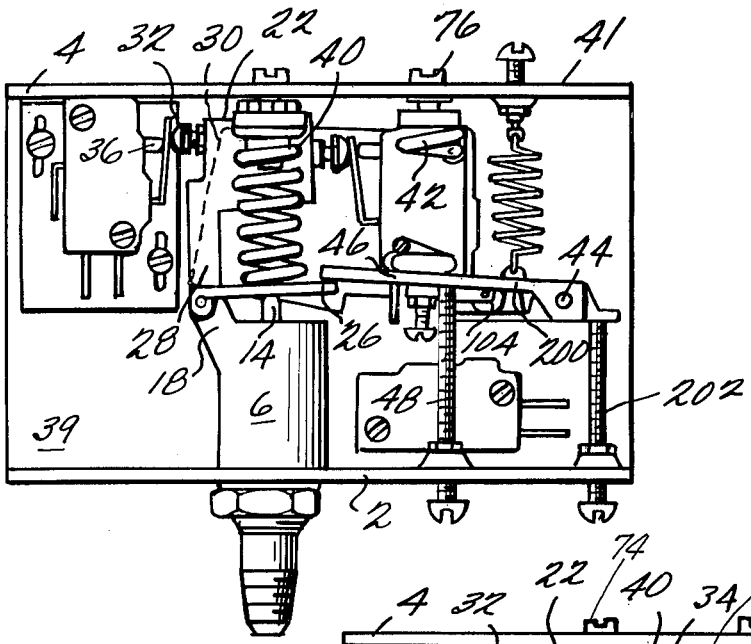
Figure 5:
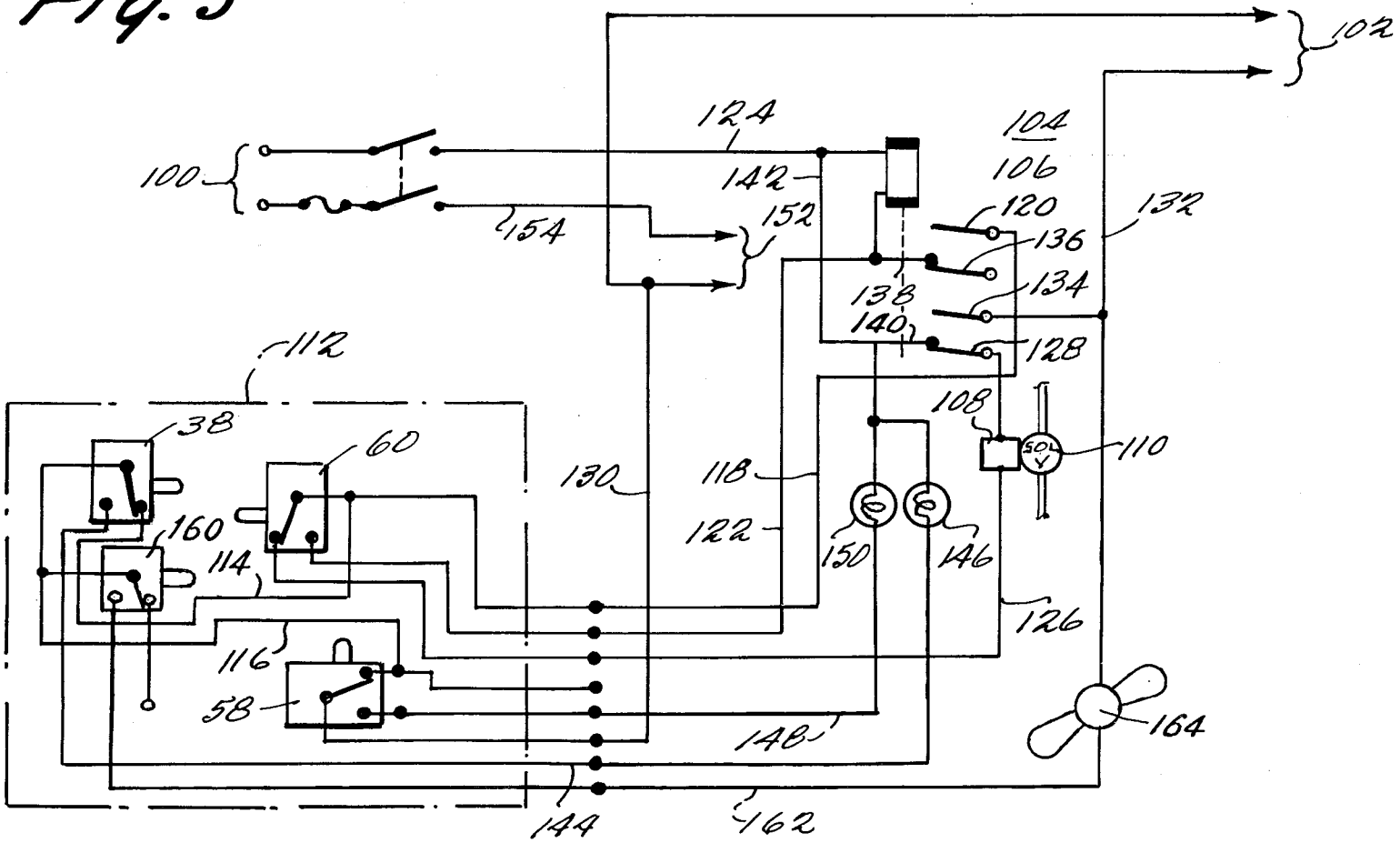

The invention will now be described more closely with reference to the attached drawings, on which FIG. 1 in an end view of one embodiment of the switch device according to the invention, with portions of the cover of the device removed, FIG. 2 illustrates the same device in a side view, FIG. 3 is the same view as FIG. 2 but with parts removed so as to illustrate some details more closely, FIG. 4 illustrates a detail of the device according to FIGS. 2 and 3, FIG. 5 is a schematic circuit diagram of the electric connections of a refrigerator machine, wherein the switching device of the invention can be utilized, FIG. 6 is a view similar to that of FIG. 2 of a further embodiment, and FIGS. 7 and 8 in similar views illustrate still further embodiments.

The switching device comprises, secured to the bottom 2 of a cover and frame structure, generally referenced 4, two housings 6 and 8, each containing a pressure responsive member, the construction of which is not illustrated more closely here but may be assumed in the present case to be of a conventional bellows type. The housings 6 and 8 each have a connecting stud 10 and 12, respectively, for connecting a pressure fluid line not shown. At the top of each housing 6 and 8, respectively, a stem 14 and 16, respectively is connected to the respective pressure sensing member and is axially movable outwards in response to a pressure increase.

At the free end thereof the housings 6 and 8 each carry a mounting lug 18 and 20, respectively rotatably supporting an actuating element 22 and 24, respectively, described more closely later, around an axis perpendicular to the respective stem axis. The actuating element 22 comprises a plate 26 abutting against the tip of the stem 14, from which an arm 28 extends substantially in the direction of the stem, said arm ending in a plate 30, extending in a plane substantially perpendicular to the pivoting axis of the actuating element. The plate 30 carries two adjustment elements 32 and 34 at two opposite side edges in the form of screw heads of two screws, which are adjustable in their longitudinal direction. The adjustment element 32 is adapted to be capable of actuating an actuating stem 36 of a micro-switch 38, which by means of an adjustment plate 38a is mounted on a wall 39 of the frame structure 4. The complete microswitch 38 is adjustable by means of the adjustment plate 38a in a direction transversally of the actuating stem 36 along the wall 39, the plate 38a being secured to the wall 39 by means of securing screws 39a extending through slots in the plate. A compression spring, 40 is acting between the plate 26 and an opposite wall 41 of the frame structure and is adapted to counteract the movement of the stem 14 upward upon a pressure increase and thereby to determine the pressure at which the microswitch 38 is to be actuated. The spring tension of the compression spring 40 is adjustable in a manner to be described later. Co-operating with the compression spring 40 is a compression spring 42, with a function to be described below more closely, acting between the wall 41 and a plate 46 pivotally supported at 44, the free end of which extends beyond the corresponding free end of the plate 26. A screw 48 which is adjustable in the wall 2 of the frame structure is adapted to restrict the movement of the plate 46 downwards by the action of the spring 42.

In FIG. 3 the members 6, 30 and 40 with their pertaining parts have been removed so as to illustrate more clearly the arrangement around the members 8 and 24 with their pertaining parts. The actuating element 24 has a plate 50 abutting against the tip of the stem 16. From the plate 50 a plate 52 extends substantially in parallel with the plate 30. At the lower edge thereof the plate 52 carries an adjustment element 54 in the form of a screw head of a screw, which is adjustable in the longitudinal direction thereof. The element 54 is adapted to operate an actuating stem 56 of a microswitch 58, which is mounted on the wall 39. The plate 52 additionally carries a microswitch 60, an actuating stem 62 of which is directed towards the adjustment element 34 to be actuated thereby and located substantially in the plane of movement of the plate.

A compression spring 64 is acting between the plate 50 and the wall 41 of the frame structure and is adapted to counteract the movement of the stem 16 in an upward direction at a pressure increase. The spring tension of the spring 64 is adjustable in a manner to be described later. The spring 64 is counteracted by a tension spring 66, the ends of which are secured to a screw 67 adjustable in the wall 41 and a projection from the lower end of the plate 52, respectively. The spring tension of the spring 66 is adjustable by means of the screw 67. When the pressure sensed by the corresponding pressure sensing member falls below a minimum value the stem 16 is lowered, and thereby the adjustment element 54 carried by the plate 52 to actuate the actuating stem 56 of the micro-switch 58.

From the description above it should be evident that a displacement upwards the stem 16 due to a pressure increase, which is sensed at the corresponding pressure sensing member, and a displacement downwards of the stem 14 due to a pressure reduction will cause a relative approach of the adjustment element 34 and the actuating stem 62, until they meet and the latter thereby is impressed. Since the element 34 and the stem 62 will not be aligned at the impression of the latter, the micro-switch 60 at the stem 62 comprises a hooked spring blade 68, by which the stem is actually actuated in the manner illustrated in FIG. 4.

By the arrangement comprising the micro-switch 60 carried by the plate 52, said micro-switch 60 will be actuated at a predetermined minimum pressure difference between the two pressure inputs, as will be described below with reference to FIG. 5.

In order to enable the adjustment of the spring pressure of the compression springs 40, 42 and 64, said springs are clamped with the upper end thereof abutting against a flange 70 of an internally threaded sleeve 72, as shown at the spring 40 in FIG. 1. Through the sleeve 72 an adjustment screw 74 extends, which has a shoulder abutting against the bottom side of the wall 41 and the top part of which is guided in a bore in the wall 41. At the spring 42 the top end of the screw has a conventional screw head 76 to allow direct relation of the screw and thereby displacement of the sleeve 72 along the screw and adjustment of the tension of the spring 42. The springs 40 and 64, on the contrary, which are selected with the same spring characteristics, are adjustable simultaneously. Thus, the adjustment screws of said springs carry identical gear wheels 78 and 80, respectively, in engagement with an intermediate gear wheel 82, which is rotatably mounted in the wall 41 by means of a stud extending through the wall and provided with an adjustment head 84 at the top side of the wall 41.

The function of the various springs in a special embodiment will be described more closely below.

FIG. 5 schematically illustrates an electric circuit diagram of the supply circuit for a single-phase AC motor for the compressor of a refrigerator installation, which can be of a conventional type well known to a person skilled in the art and therefor not described more closely here. It should also be easily understood that the description below with certain modifications is likewise valid also for a three-phase installation. With 100 the supply terminals of the circuit are indicated and with 102 the supply lines to the motor of the compressor and the corresponding start relay. Between the terminals 100 and 102 there is a primary relay, generally indicated 104, with a solenoid valve 110 included in a conventional manner in the relief stage of the compressor. In the three-phase case the relay is replaced by a three-phase contactor with actuating contacts corresponding to those described below more closely. The connection operations of the primary relay 104 and the solenoid valve 110 are controlled by the switch device of the invention, which is illustrated schematically at 112 with dash-dot lines. The switch device 112 comprises the micro-switches 38, 58 and 60 described above, each of which comprises a movable contact element and two stationary contact elements.

In the switch device 112 the movable contact element of the micro-switch 112 is connected via a line 114 to one of the stationary contact elements in the micro-switch 38 and the movable contact element of the micro-switch 38 is via a line 116 connected to one of the stationary contact elements in the micro-switch 58. In addition, the movable contact element of the micro-switch 60 is connected via a line 118 to one contact element 120 in the relay 104 and one of the stationary contact elements thereof is connected via a line 122, the relay coil 106 and a line 124 to one of the supply terminals 100. The second stationary contact element of the micro-switch 60 is connected via a line 126 and the coil 108 to a rest contact element 128 of the relay 104. The movable contact element of the micro-switch 58 is connected via a line 130 to one of the terminals 102, the second of the terminals 102 being connected via a line 132 to a contact element 134 in the relay 104. In addition, the relay 104 is provided with a rest contact element 136 and comprises two movable contact elements 138 and 140, respectively, which, upon excitation of the relay coil 106, are brought into contact with the contact elements 120 and 134. The contact element 138 is connected to the line 122 and the contact element to the line 124 via a line 142.

The second stationary contact element of the micro-switch 38 is connected via a line 144 and an indicator lamp 146 to the line 142. Likewise the second stationary contact element of the micro-switch 58 is connected via a line 148 and an indicator lamp 150 to the line 142.

Finally, the line 130 is connected to the second of the supply terminals 100 via the motor protector at the terminals 152 and a line 154.

FIG. 5 shows the circuit in rest position. When the circuit is closed a start relief of the refrigerator machine is always initiated by the opening of the start valve 110 by energizing the coil 108 via a circuit formed via the lines 124, 142, the relay contacts 140, 128, the coil 108, the line 126, the micro-switch 60, the line 114, the micro-switch 38, the line 116, the micro-switch 58, the line 130, the terminals 152 and the line 154. The pressure at the high pressure side of the refrigerator installation, hereinafter referred to as the high pressure, is thereby reduced and in certain cases the pressure at the low pressure side of the refrigerator installation, hereinafter referred to as the low pressure, increases. These pressure changes are converted by the switch 112 to angular movements, which are measured and monitored by the switch and are converted into various electric switching operations.

In order to simplify the following description the terms $\alpha H$ and $\alpha L$ are introduced for the angular deflections of the actuating elements 22 and 24 relative to a common reference level under the influence of the pressures occurring at the pressure inputs 10 and 12, respectively, which are connected to the high pressure and low pressure sides, respectively, of the refrigerator installation.

During the relief process the angles αH and αL approach each other, whereby the actuating element 22 and the micro-switch 60 approach each other. Finally, the angles become equal, whereby the actuating stem 62 is actuated by the element 34 of the actuating element 22 and thereby the movable contact element of the micro-switch 60 is switched from the position shown in FIG. 5 into contact with the second stationary contact element of the micro-switch 60. Hereby the coil 106 of the relay 104 is energized by a circuit formed via the line 124, the coil 106, the line 122, the micro-switch 60, the line 114, the micro-switch 38, the line 116, the micro-switch 58, the line 130, the terminals 152 and the line 154. Hereby the contacts 138 and 140 of the relay 104 are actuated into contact with the contacts 120 and 134, at the same time as the coil 108 of the solenoid valve is de-energized and the solenoid valve is closed. Starting current is also supplied to the start relay by closing a circuit through the lines 124, 142, the relay contacts 140, 134, the line 132, the start relay, the motor protector at the terminals 152 and the line 154.

Consequently, the refrigerator installation is started completely relieved, whereby the high pressure is increased and the low pressure is reduced, the difference αH — αL increasing so that the impression of the actuating stem 62 by means of the element 34 of the actuating element is eliminated and the micro-switch 60 is switched to assume again the rest position as shown in FIG. 5.

The cycle of operation of the refrigerator installation is now continued, until the temperature corresponds to the set minimum value of the low pressure, i.e., the value at which the switch 58 will be actuated by the pressure of the adjustment element 54 against the actuating stem 56. Hereby the switch 58 interrupts the circuit of the motor relay and the refrigerator installation is stopped.

As the temperature is now rising in the refrigerated space, the low pressure is also increased to the low pressure value set, so that the switch 58 can switch over again, whereby the installation will be started via a new relief process in the manner described above.

If for some reason, during the time the installation is in operation, the high pressure should become too high and surpass the set maximum high pressure value for actuating the micro-switch 38, said switch will be actuated by the element 32 of the actuating element 22 pressing against the actuating stem 36 so that the movable contact element of the switch 38 will be switched into its position in contact with the stationary element connected to the line 144. Hereby the circuit to the motor relay is interrupted and the installation is stopped, until the high pressure is reduced to the value at which the switch 38 is again switched into its rest position, whereby the installation is started again via a renewed starting relief in the manner described above.

When the switches 38 and 58 have been switched in the manner described above into the contact positions not shown in FIG. 5 it should be observed that circuits through the indicator lamps 150 and 146 will be closed via the respective lines 148 and 144.

It is also possible to provide in the switch device described above an additional switch at the same side of the actuating element 22 as the switch 38 and, as shown with dotted lines at 160 in FIG. 5, adapted to be actuated by said element. Said switch is then connected at 162 in order to close a circuit for the condensor blower motor comprised in the refrigerator installation, when the high pressure in the refrigerator installation continues to increase and, when required, reaches the set high pressure value. When this motor is started, the high pressure is reduced and may possibly pass below the difference value, whereby said switch will interrupt the circuit. In other words, the condensation pressure is monitored by said switch and it does not disturb other electric functions.

In order that the device according to the invention should operate in a proper manner in accordance with the embodiment described in connection with FIG. 5 the pressure sensing members, i.e., the pressure bellows in the cylinders 6 and 8, should be equal and the respective compression springs 40 and 64 should have equal characteristics and be simultaneously adjustable by means of the gear wheels 78, 80, 82 in order to obtain equal angular deflection within the pressure range, wherein the start relief pressure occurs, up to +30° C. The adjustment of the device is initiated by setting the point of closing at a desired maximum temperature for the refrigerator installation by means of the adjustment screw 84. Thereafter the desired breaking point at the minimum temperature is set by means of the adjustment screw 67. The spring 42 is adjusted by means of the adjustment screw 76 in order to determine the pressure at which the compressor should start by actuating the additional switch 160. The being of the range, within which the high pressure part of the switching device is to begin to act against the spring 42 is set by means of the adjustment screw 48. The breaking point of the switch 38 is regulated by means of the adjustment screw 32 and the difference thereof is set by raising or lowering the switch along the wall 39 by means of the plate 38a.

From the description above it is evident that the switching device according to the invention is capable of providing a start impulse exactly and independently of the mixture pressure value of the refrigerator installation, when the starting torque is at its minimum at start relief, and the basic idea is thus that the electric motor of the freezer-refrigerator installation should be fully utilized but not overloaded. In addition, the installation can operate as a pressure control for high pressure and low pressure with separately adjustable maximum and minimum values for the input values.

In comparison with the embodiment shown in FIGS. 1 through 4, wherein the member 24 is actuated by a spring 64, the embodiment shown in FIG. 6 comprises an additional lever 200 pivotally supported on the stud 44, said lever at one side of the stud 44 being actuated by the spring 66 and at the other side being provided with an abutment in the form of a screw 202. The member 24 acts against the left-hand arm of the lever 200 via a wheel 204. The member 24 is thus actuated here by the spring 66 via the lefthand arm of the lever 202 and the rolling engagement of the wheel 204 against said arm.

Figure 7:
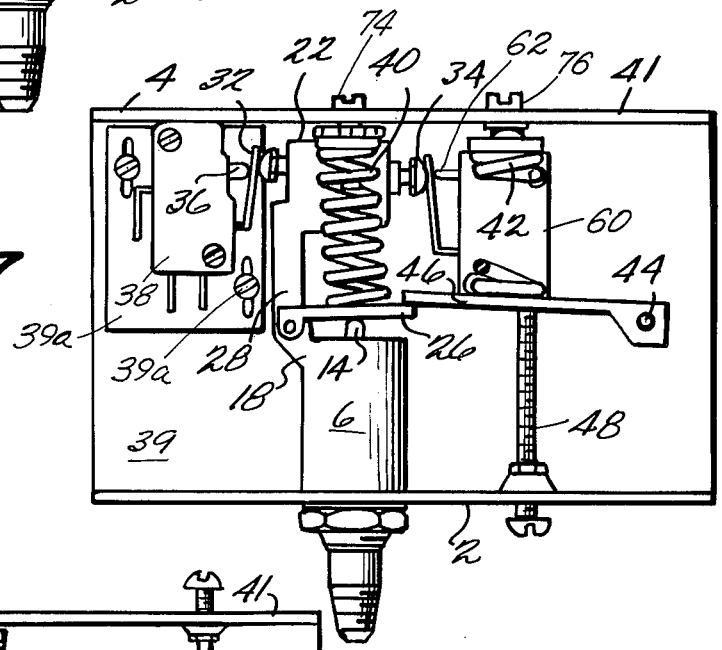
Figure 8:
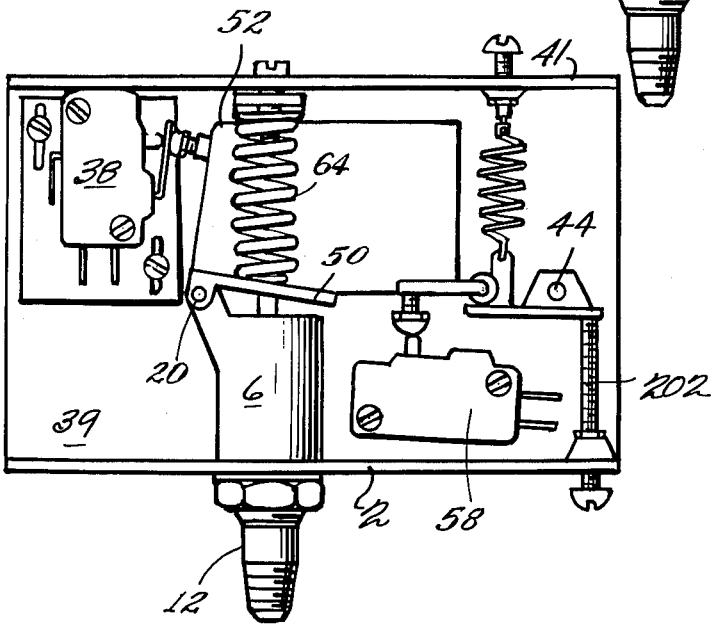

FIGS. 7 and 8 illustrate modifications of the embodiments of FIGS. 1 through 4 and 6, respectively. The modification according to FIG. 7 is intended only for low pressure monitoring and the modification according to FIG. 8 only for high pressure monitoring in a refrigerator installation similar to the one shown in FIG. 5. The operation is generally analogous with that described with reference to the embodiment according to FIGS. 1 through 4 and with reference to FIG. 5 and need not therefore be described more closely here.

The present invention is, of course, not restricted to the embodiments described above and shown on the drawings but may be modified within the scope of the claims. Consequently, a person skilled in the art will understand that the switch device according to the present invention is also useful within other fields of application than within the refrigerator and freezer techniques.

What I claim is:

1. A pressure responsive switching device comprising:

a housing;

a pressure input including a pressure responsive member having a path of movement along which it is movable in response to pressure variations at said pressure input;

a pivotally mounted actuating member swingable by said pressure responsive member in response to said pressure variations at said pressure input;

a first electric switch having a movable contact element, said first electric switch being positioned to allow said actuating member to actuate said movable contact element by exerting a force thereon by a swinging movement and at a certain position of actuation upon the occurrence of a predetermined pressure at the pressure input;

means for adjusting said certain position of actuation of said actuating member, including means for shifting said first electric switch and thereby said movable contact element thereof, in a direction essentially transverse to the direction of movement of said movable contact element;

a second electric switch having a movable contact element, said second electric switch being positioned to allow said actuating member to actuate the movable contact element thereof upon the occurrence of a second predetermined pressure at the pressure input which is lower than said first predetermined pressure;

a first compression spring acting between said housing and said actuating member along said path of movement of said pressure responsive member for counteracting movement of said actuating member upon rising pressures;

means for continuously adjusting the force of said first spring;

pivotably mounted lever means;

a second compression spring extending in parallel with said first compression spring and acting between said housing and said pivotally mounted lever means;

means for continuously adjusting the force of said second spring;

settable stop means for restricting the freedom of movement of said lever means by the pressure exerted by said second spring, said lever means extending into the path of movement of said pivotally mounted actuating member, and said actuating member having an abutment for lifting said lever means from said settable stop means above a desired pressure level at said pressure input, so as to initiate co-operation between said first and second springs above said desired pressure level.

* * * * *